US006735996B2

(12) United States Patent
Heussen et al.

(10) Patent No.: US 6,735,996 B2
(45) Date of Patent: May 18, 2004

(54) METHOD OF MAKING AN AXLE ELEMENT FOR A MOTOR VEHICLE, AND SHAPING DIE FOR CARRYING OUT THE METHOD

(75) Inventors: Michael Heussen, Hünxe (DE); Bernard Comte, Courtételle (CH); Vincent Von Niederhäusern, Alle (CH); Andreas Baak, Gütersioh (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 10 days.

(21) Appl. No.: 10/126,475

(22) Filed: Apr. 19, 2002

(65) Prior Publication Data

US 2002/0157444 A1 Oct. 31, 2002

(30) Foreign Application Priority Data

Apr. 23, 2001 (DE) ..... 101 19 839

(51) Int. Cl.[7] ..... B21J 13/02

(52) U.S. Cl. ..... 72/355.6; 72/356

(58) Field of Search ..... 72/352, 355.2, 72/355.6, 356, 377, 259, 260, 357

(56) References Cited

FOREIGN PATENT DOCUMENTS

JP 6-315734 * 11/1994 ..... 73/355.6

* cited by examiner

*Primary Examiner*—Lowell A. Larson
(74) *Attorney, Agent, or Firm*—Henry M. Feiereisen

(57) ABSTRACT

In a method of making an axle element for a motor vehicle, a rod-shaped semi-finished product of aluminum is use used as starting material and heated to a desired shaping temperature. A first end of the semi-finished product is upset in a cavity of a shaping die by means of a first punch. Subsequently, the other end of the semi-finished product is compressed in the cavity by a second punch, whereby compressed material is forced into a branch of the cavity to form a pre-forge part with a leg portion. The pre-forge part is then forged into a finished axle element, e.g. a swivel bearing.

13 Claims, 2 Drawing Sheets

3
3a
9
8
10
1
3b
4
7
6
2
5

3
8
9
10
11
1,12
4
7
6
2
5

METHOD OF MAKING AN AXLE ELEMENT FOR A MOTOR VEHICLE, AND SHAPING DIE FOR CARRYING OUT THE METHOD

CROSS-REFERENCES TO RELATED APPLICATIONS

This application claims the priority of German Patent Application Serial No. 101 19 839.6, filed Apr. 23, 2001, pursuant to 35 U.S.C. 119(a)–(d), the subject matter of which is incorporated herein by reference.

BACKGROUND OF THE INVENTION

The present invention relates, in general, to a method of making an axle element for a motor vehicle, and to a shaping die for carrying out the method.

Axle elements for motor vehicles, in particular swivel bearings for the front axle, constitute fairly complex single-piece components which are cast or forged and are made of a cast steel material or aluminum. As swivel bearings are exposed to severe forces, they have generally been manufactured of solid material. Weight concerns made it increasingly likely to manufacture swivel bearings of light metals such as aluminum.

Swivel bearings of aluminum are typically made through a forging process by using a blank in the form of an extruded round stock. A problem associated with this approach is the fact that finished swivel bearings have a very irregular weight distribution which, however, is not reflected in the cylindrical shape of the blank. In order to still provide those regions that require more mass than other regions with enough material for the forging process, it has been proposed to use sufficiently sized blanks. This approach suffers also shortcomings in view of the substantial energy consumption required to heat the blank to the desired forge temperature for the hot forming process. Moreover, the volume of encountered waste is relatively high in those regions of lesser mass accumulations. This adversely affects costs considerations, especially when taking into account that aluminum is a comparably expensive material. These problems are not only true for swivel bearings but apply for axle elements in general.

It would therefore be desirable and advantageous to provide an improved method of making an axle element for motor vehicles, to obviate prior art shortcomings and to reduce the energy amount required for the forming process and the material consumption required for the manufacture.

SUMMARY OF THE INVENTION

According to one aspect of the present invention, a method of making an axle element for a motor vehicle, includes the steps of heating a rod-shaped semi-finished product of aluminum to a desired shaping temperature; upsetting one end of the semi-finished product in a cavity of a shaping die by means of a first punch; compressing another end of the semi-finished product in the cavity by a second punch and thereby forcing compressed material into a branch of the cavity to form a pre-forge part with a leg portion; and forging the pre-forge part into a finished axle element.

The present invention resolves prior art problems by altering the even mass distribution of the rod-shaped semi-finished product, in particular round stock, in such a manner with respect to the axle element to be manufactured, that in a pre-stage of the actual forging process more material is made available in regions of greater material accumulations than in other regions. As a consequence, a mass distribution is realized which resembles the mass distribution of the axle element to be manufactured.

Upsetting is realized by providing the shaping die with a cavity which has an internal shape to permit a material thickening in discrete regions. Depending on the internal shape of the cavity, one end of the semi-finished product may be compressed directly by the punch. The cavity may also have an impression at a distance to the one end of the semi-finished product for receiving displaced material as a result of compressive deformation during the upsetting process. The geometric configuration of the cavity is determined under consideration of certain diametrical ratios and/or length ratios of compressed regions. To prevent surface creases, the length of compressive deformation should not be greater than five times the diameter of the semi-finished product. Upsetting is implemented by advancing the semi-finished product to the first punch and moving the punch at a speed of up to 150 mm/s along the predetermined length of compressive deformation.

Once the one end of the semi-finished product has been upset, the second punch acts on the other end of the semi-finished product to press it into the cavity. Compressed material flows backwards into the branch of the cavity, whereby the branch extends at an angle to the longitudinal center axis of the rod-shaped semi-finished product. Hereby, the compressed material is shaped into a leg portion of the semi-finished product. The branch may be situated halfway of the length of compressive deformation. Suitably, the cavity is so configured that a neutral axis is defined in the area of the longitudinal center axis of the formed leg portion. This ensures that the neutral axis flows into the flash in the following final forging step in the forging die to thereby provide an unobjectionable and aligned texture of the structural element. The recrystallization behavior of the neutral axis is influenced by the parameters, punch speed, temperature of the shaping die and the semi-finished product, geometry of the cavity, and friction on the cavity surface. Recrystallization can be reduced to a minimum through optimized selection of these parameters.

In accordance with the present invention, a single shaping die can be used to combine two different processes. On the one hand, the end of the semi-finished product can be upset, and, on the other hand, a leg portion can be formed through compressive deformation, without requiring a transfer of the rod-shaped semi-finished product between these two manufacturing steps. Once the semi-finished product is transformed into a pre-forge part, the final forging process is carried out to produce the finished product, e.g. axle element.

The method according to the present invention has many advantages. Semi-finished products, such as extruded round stock with slight initial cross section, can be used and shaped to have a beneficial mass distribution for the forging process. At the same time, the energy consumption for heating the semi-finished product is reduced as a consequence of the small mass of the semi-finished products. Moreover, flash losses during the forging process are smaller because the pre-forge part has already a configuration which close resembles the final configuration, so that less initial material is required.

The upsetting forces and compressive forces for backflow of material are suitably applied in horizontal direction to simplify the overall construction of the shaping die. In order to keep the shaping die closed during the deformation process, the clamping force acting on the shaping die should be about ten times the force applied by the first and second punches.

According to another feature of the present invention, the other end of the semi-finished product is pressed in the cavity by the second punch against a restraining force applied by the first punch. Thus, the first punch assumes a dual function, namely upsetting one end of the semi-finished product and providing an abutment for operation of the second punch, without loss of time or need for repositioning the workpiece for initiating the compressive operation by the second punch. In a same way, the second punch provides an abutment during upsetting operation of the first punch.

While blanks are heated during hot forging to a temperature above the recrystallization temperature to avoid a remaining hardening of the workpiece material, it is sufficient to heat a pre-forge part of aluminum during manufacture to a shaping temperature of less than 520° C., even as low as between 420° C. and 480° C. Shaping at a too low temperature may cause a dislocation density not yet degraded, that may lead during following heating to forge temperature to an uncontrolled and undesired coarse grain formation through recrystallization processes.

According to another feature of the present invention, the upsetting step is repeated in a cavity of a further shaping die before the forging step. This may be advantageous in those situations in which the upsetting forces applied by the first punch should not exceed a predetermined level so that material is prevented from an uncontrolled flow into the branch of the cavity but enters the branch in a controlled manner only during the compression step by means of the second punch. The provision of a second shaping die enables an even closer configuration of the pre-forge part to the final configuration.

According to another feature of the present invention, the pre-forge part is heated to a forge temperature before the forging step. In this way, a permanent hardening of the workpiece material is prevented. Suitably, the forge temperature is above the recrystallization temperature, e.g. about 520° C.

The method according to the present invention is applicable for the manufacture of differently configured axle elements, in particular the production of swivel bearings.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
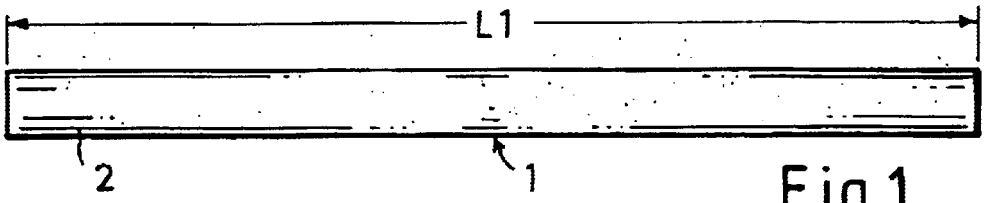
FIG. 1 is a schematic illustration of a rod-shaped semi-finished product used in a method according to the present invention.

Throughout all the Figures, same or corresponding elements are generally indicated by same reference numerals.

Turning now to the drawing, and in particular to FIG. 1, there is shown a schematic illustration of a rod-shaped semi-finished product used in a method according to the present invention, generally designated by reference numeral 1. The semi-finished product 1 is an extruded round stock made of aluminum and has a length L1. In an initial step, not shown here, the semi-finished product 1 is heated to a temperature of 450° C. before subjected to the two-step shaping process by means of a shaping die, generally designated by reference numeral 3 and illustrated in more detail in FIGS. 5 and 6.

Figure 2:
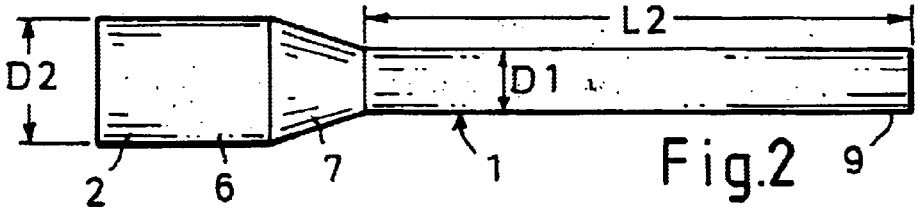
FIG. 2 is a schematic illustration of the semi-finished product after one end has been upset.
Figure 5:
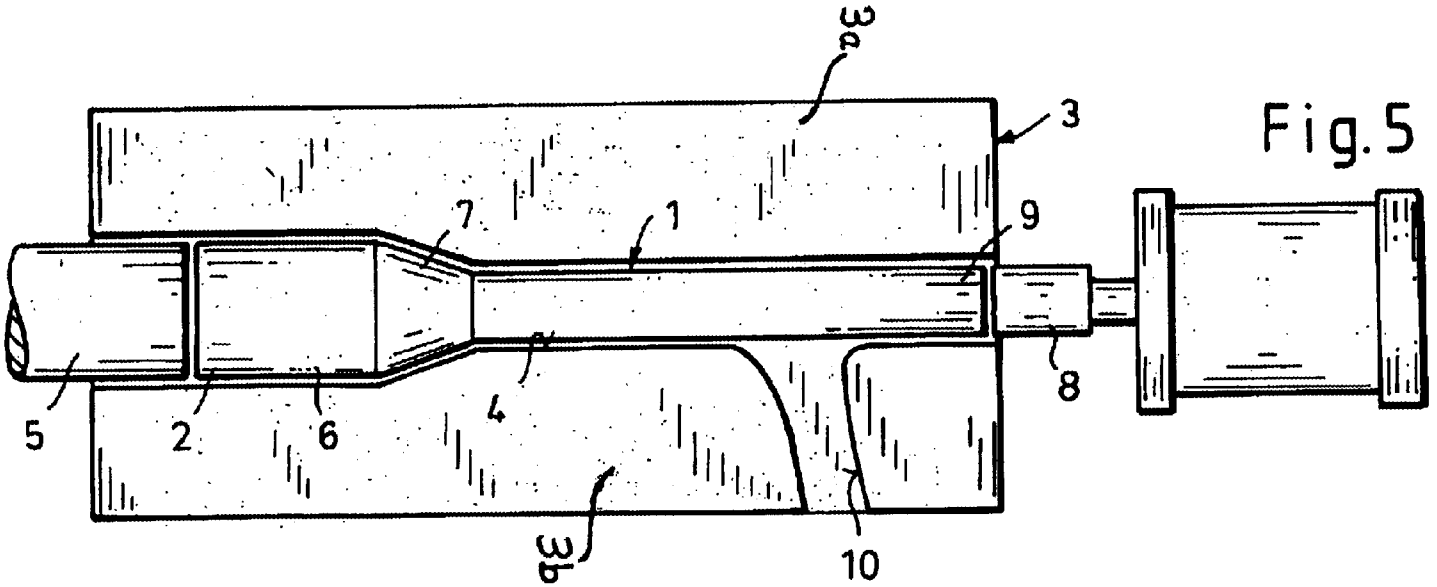
FIG. 5 is a sectional view of a shaping die for carrying out the method according to the present invention, showing the first process step to upset one end of the semi-finished product.
Figure 6:
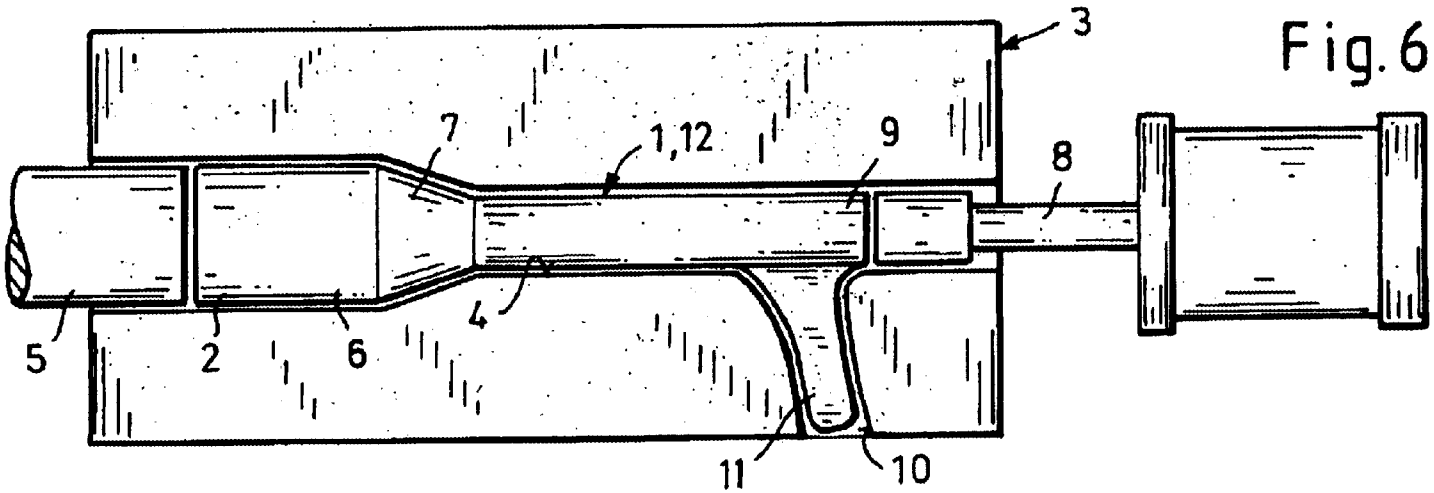
FIG. 6 is a sectional view of the shaping die of FIG. 5 after formation of the leg portion.

FIG. 5 shows the first shaping process which involves upsetting of one end portion 2 of the semi-finished product 1 to thereby shorten the semi-finished product 1 and to provide the one end portion 2 with a diameter D2 which is approximately twice the size of the diameter D1 of the remaining portion of the semi-finished product 1 having a length L2, as shown in FIG. 2. The length L2 of the remaining portion of the semi-finished product 1 is approximately more than half the initial length L1 of the non-shortened semi-finished product 1.

The shaping die 3 has an upper die member 3*a* and a lower die member 3*b* which form together a cavity 4 in which the semi-finished product 1 is placed and embraced by the die members 3*a*, 3*b*. The lower die member 3*b* is formed in closer proximity to the other end portion 9 of the semi-finished product 1 with a branch channel 10 which is in communication with the cavity 4. A first punch 5 is positioned in horizontal direction adjacent the one end portion 2 of the semi-finished product 1, while a second punch 8 is positioned in horizontal direction adjacent the other end portion 9 of the semi-finished product 1.

At operation, the punch 5 acts on the one end portion 2 to compress it in conformity with the internal shape of the cavity 4, whereby the second punch 8 provides a counter-force to ensure a secure hold of the semi-finished product in the cavity 4. The end portion 2 of the semi-finished product 1 is hereby shaped into a configuration comprised of a cylindrical end section 6, defined by the diameter D2, and a conical transition 7, which is tapered towards the remaining portion of the semi-finished product 1 having the diameter D1. The resultant product after this shaping step is shown in FIG. 2.

Figure 3:
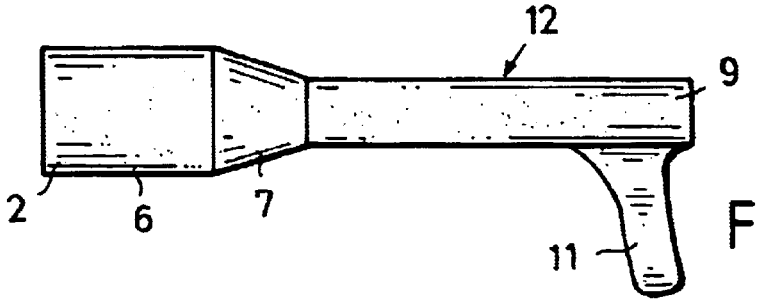
FIG. 3 is a schematic illustration of a pre-forge part formed of the upset semi-finished product and having a leg portion at the other end.

After the upsetting operation of the end portion 2, the punch 5 assumes now the task of an abutment while the second punch 8 presses the end portion 9 of the semi-finished product 1 into the cavity 4. As a result, compressed material is displaced into the branch channel 10 of the cavity 4 to form a leg portion 11 at the end portion 9 of the semi-finished product 1. The resultant product after this shaping step is pre-forge part 12 and shown in FIG. 3. The leg portion 11 is configured in conformity with the internal shape of the branch 10 in such a way that the compression results in a beneficial fiber pattern in the pre-forge part 12. In other words, the branch 10 and the resultant leg portion 11 are defined at the transition zone to the elongated cavity 4 and semi-finished product 1, respectively, with a radius that results in a streamlined transition.

Figure 4:
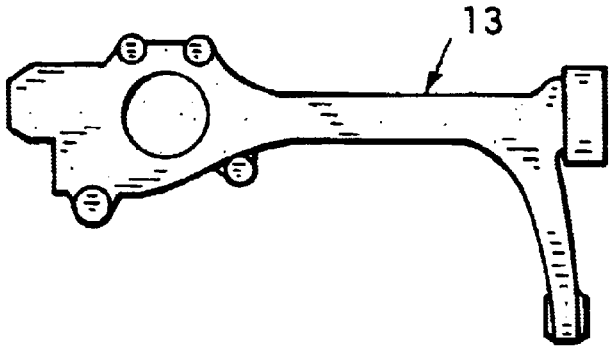
FIG. 4 is a schematic illustration of a finished swivel bearing formed from the pre-forge product.

Although not shown in detail, the next method step involves a removal of the pre-forge part 12 from the shaping die 3 and subsequent heating of the pre-forge part to a forging temperature of about 520° C. Then, the pre-forge part 12 is shaped by a forging process to assume the final configuration for use as a swivel bearing 13, as shown in FIG. 4.

While the invention has been illustrated and described as embodied in a method of making an axle element for a motor vehicle, and to a shaping die for carrying out the method, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. A method of making an axle element for a motor vehicle, comprising the steps of:

heating a straight-lined rod-shaped semi-finished product of aluminum to a desired shaping temperature;

upsetting a first end of the semi-finished product in a cavity of a shaping die by a first punch;

compressing a second end of the semi-finished product in the cavity by a second punch against a restraining force applied by the first punch, thereby forcing compressed material into an open-ended branch of the cavity to form a pre-forge part with a leg portion; and forging the pre-forge part into a finished axle element.

2. The method of claim 1, wherein the shaping temperature is less than 520° C.

3. The method of claim 1, wherein the shaping temperature is between 420° C. and 480° C.

4. The method of claim 1, wherein the upsetting step is repeated in a cavity of a further shaping die before the forging step.

5. The method of claim 1, wherein the pre-forge part is heated to a forging temperature before the forging step.

6. The method of claim 5, wherein the forging temperature is about 520°C.

7. The method of claim 1, wherein the axle element is a swivel bearing.

8. The method of claim 1, wherein the first and second punches are moved in a horizontal direction.

9. A shaping die for making an axle element for a motor vehicle, comprising:

an upper die member;

a lower die member disposed in opposition to the upper die member and defining together with the upper die member a cavity for receiving a straight-lined semi-finished product having opposite ends, said lower die member having an open-ended branch channel in communication with the cavity;

a first punch placed adjacent one end portion of the semi-finished product and constructed to move in a direction of the semi-finished product to upset the one end portion and thereby shape the one end portion to conform to an internal shape of the cavity; and a second punch placed adjacent the other end of the semi-finished product and constructed to move in a direction of the semi-finished product to compress the other end portion in opposition to the first punch and thereby force material of the semi-shaped product into the branch channel to shape a leg portion in conformity with an internal shape of the branch channel.

10. The shaping die of claim 9, wherein the branch channel extends at an angle to a longitudinal center axis defined by the cavity.

11. The shaping die of claim 10, wherein the first punch is stationary and provides a counterforce, when the second punch is moved, and the second punch is stationary and provides a counterforce, when the first punch is moved.

12. The shaping die of claim 9, wherein the upper and lower die members are closed by a clamping force which is about ten times a force applied by the first and second punches.

13. The shaping die of claim 9, wherein the first and second punches are moved in a horizontal direction.

* * * * *